US006739294B1

(12) United States Patent
Liedtke et al.

(10) Patent No.: US 6,739,294 B1
(45) Date of Patent: May 25, 2004

(54) MANIFOLD FOR HOUSING HIGH-PRESSURE OIL IN A CAMLESS ENGINE

(75) Inventors: Jennifer L. Liedtke, Rochester, MI (US); Thomas E. Wenzel, Davison, MI (US)

(73) Assignee: General Motors Corporation, Detroit, MI (US)

( * ) Notice: Subject to any disclaimer, the term of this patent is extended or adjusted under 35 U.S.C. 154(b) by 0 days.

(21) Appl. No.: 10/461,582

(22) Filed: Jun. 13, 2003

(51) Int. Cl.[7] ..... F01L 9/02

(52) U.S. Cl. ..... 123/90.13; 123/90.12; 123/195 R; 29/888.01; 29/888.06; 60/626

(58) Field of Search ..... 123/90.13, 90.12, 123/90.15, 195 R, 198 P; 60/625–627; 29/888.01, 888.06

(56) References Cited

U.S. PATENT DOCUMENTS 5,456,223 A 10/1995 Miller et al. ..... 123/90.12
5,713,316 A 2/1998 Sturman ..... 123/90.12
5,829,396 A 11/1998 Sturman ..... 123/90.12
5,970,956 A 10/1999 Sturman ..... 123/508
6,024,060 A 2/2000 Buehrle, II et al. ..... 123/90.12
6,308,690 B1 10/2001 Sturman ..... 123/508
6,349,685 B1 2/2002 Kolmanovsky et al. .. 123/90.11
6,354,185 B1 3/2002 Sturman ..... 91/454
6,360,728 B1 3/2002 Sturman ..... 123/508
6,543,405 B2 * 4/2003 Sachdev et al. ..... 123/195 R
6,591,796 B1 * 7/2003 Scott ..... 123/90.13

* cited by examiner

*Primary Examiner*—Thomas Denion
*Assistant Examiner*—Kyle Riddle
(74) *Attorney, Agent, or Firm*—Leslie C. Hodges

(57) ABSTRACT

A manifold for housing high-pressure oil on a camless engine includes an extruded aluminum body having first and second ends. First, second and third extruded channels are formed in the body and each extends from the first end to the second end of the body. The manifold has a plurality of switching valve mounting bores configured to receive a plurality of switching valves operative to alternately communicate the channels with intake and exhaust valves of an engine to which the manifold is mounted to affect movement of the valves.

12 Claims, 4 Drawing Sheets

MANIFOLD FOR HOUSING HIGH-PRESSURE OIL IN A CAMLESS ENGINE

TECHNICAL FIELD

The present invention relates to an extruded aluminum manifold having three channels formed therein to facilitate operation of hydraulic switching valves for controlling intake and exhaust valves in a camless engine.

BACKGROUND OF THE INVENTION

Internal combustion engines typically include intake and exhaust valves which are operated by cams on a camshaft associated with the engine. Camless engines with electrically or hydraulically controlled valves have been proposed to provide improved control of valve operation in order to achieve valve movement which does not depend upon the contours of a cam surface. For example, an electrically or hydraulically controlled engine may enable valves to open multiple times during an engine cycle, or not at all, such as in a cylinder deactivation system. Electrically or hydraulically controlled valves may make timing adjustment easier and provide fully flexible valve actuation control.

Various designs of hydraulic switching valves have been developed to enable potentially efficient implementation of hydraulic control for intake and exhaust valves on a camless engine.

SUMMARY OF THE INVENTION

The present invention provides an extruded aluminum manifold for a hydraulically actuated camless engine which enables implementation of the above mentioned hydraulic switching valves in a mass-produced camless engine.

More specifically, the invention provides a manifold for housing-high-pressure oil on a camless engine, including an extruded aluminum body having first and second ends, and having first, second and third extruded channels formed therein and each extending from the first end to the second end of the body. The body has a plurality of switching valve mounting bores configured to receive a plurality of switching valves operative to alternately communicate the channels with intake and exhaust valves of an engine to which the manifold is mounted.

Preferably, the body includes at least eight of the switching valve mounting bores formed therein. End caps are bolted to first and second ends of the body to enclose the first, second and third channels.

Extruding the aluminum body provides the high tensile and yield strength properties required to withstand the stresses induced by the high-pressure oil. Use of aluminum is preferred over other high strength materials such as steel because it weighs significantly less.

The extrusion allows the formation of long internal passages of uniform cross-section for containment of the oil. Long oil channels of substantial volume are preferred for valve control at the hydraulic switching valves to minimize pressure and noise pulses. One of the first, second and third channels is configured to receive high-pressure oil, and is substantially oval-shaped in vertical cross-section to provide reduced stress.

The hydraulic switching valve mounting bores or mounting pockets intersect or are connected with the appropriate channels to facilitate fluid communication.

The use of one oil manifold per row of engine valves, which is facilitated by use of an aluminum extrusion, minimizes sealing surfaces for reduced opportunity for leaks. Further, all potential leak paths at the hydraulic switching valve to manifold interface are internal to the manifold.

The invention also contemplates a method of manufacturing an oil manifold for a camless engine including the steps of: (A) extruding an aluminum member having first, second and third channels formed therein; (B) cutting the extruded aluminum member to a desired length to form a manifold body having first and second ends with the first, second and third channels extending from the first end to the second end; and (C) machining a plurality of switching valve mounting bores into the manifold body in fluid communication with the first, second and third channels.

The invention also provides a camless engine including a cylinder valve (i.e., an intake or exhaust valve) operatively associated with an engine cylinder and having a return spring biasing the cylinder valve toward a closed position. A fluid aperture is operatively associated with the valve to provide pressurized fluid to selectively counteract force of the return spring to actuate movement of the valve toward an open position. The fluid aperture is formed in an extruded aluminum manifold body having first, second and third channels formed therethrough for carrying oil at different pressures. A hydraulic switching valve is operatively positioned in the manifold body between the fluid aperture and at least two of the first, second and third channels to alternately communicate the two channels with the fluid aperture, wherein one of the two channels carries high-pressure oil and the other of the two channels carries low-pressure oil. Accordingly, high-pressure or low-pressure oil can communicate with the cylinder valve through the fluid aperture (via a force translator) to affect movement of the cylinder valve between the open and closed positions.

The above objects, features, advantages and other objects, features and advantages of the present invention are readily apparent from the following detailed description of the best mode for carrying out the invention when taken in connection with the accompanying drawings.

DESCRIPTION OF THE PREFERRED EMBODIMENT

Figure 1:
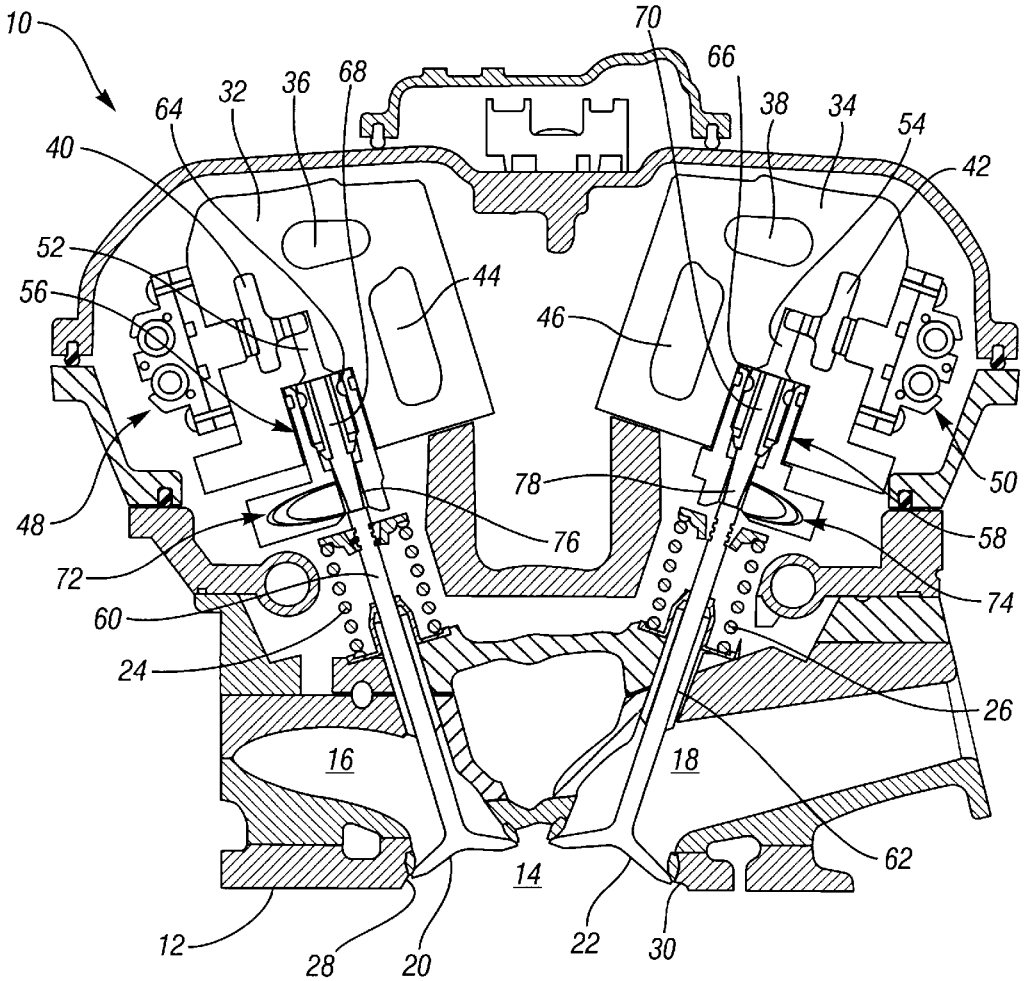
FIG. 1 shows a vertical cross-sectional view of a camless engine in accordance with the invention.

Referring to FIG. 1, a vertical cross-sectional view of a camless engine 10 is shown in accordance with the present invention. The camless engine 10 includes a cylinder head 12 having a plurality of cylinders formed therein in communication with exhaust and intake ports 16, 18. The position of one such cylinder is identified with reference number 14 in FIG. 1, although the cylinder is not shown. The exhaust and intake ports 16, 18 are selectively communicated with the cylinder 14 by opening and closing the exhaust and intake valves (also referred to herein as cylinder valves) 20, 22.

The return springs 24, 26 bias the exhaust and intake valves 20, 22 toward a closed position against the respective valve seats 28, 30, respectively.

Typically, exhaust and intake valves are actuated by cams on a cam shaft. However, in the camless engine of the present invention, movement of the exhaust and intake valves 20, 22 against the force of the return springs 24, 26 is actuated hydraulically via high-pressure oil in the manifolds 32, 34. Each manifold 32, 34 includes a high-pressure channel 36, 38 for carrying oil at high pressure, such as 3,000 p.s.i. The manifolds 32, 34 also each include a low-pressure channel 40, 42 for carrying oil at approximately 50 p.s.i. The manifolds 32, 34 further include a control pressure channel 44, 46 for carrying oil at approximately 350 p.s.i. for use in controlling the switching valves 48, 50.

The switching valves 48, 50 are operative to alternatively connect the high-pressure channels 36, 38 and low-pressure channels 40, 42 with the fluid apertures 52, 54 for actuating the valves 20, 22.

The switching valves 48, 50 selectively communicate the low-pressure and high-pressure channels 36, 38, 40, 42 with the fluid apertures 52, 54 in a manner to either overcome the force of the respective return springs 24, 26 to open the valves 20, 22, or to allow the return springs 24, 26 to return the respective valves 20, 22 to the closed position. The pressure in the control channels 44, 46 are used by the switching valves 48, 50 for controlling actuation.

A working description of the switching valves 48, 50 is described in detail in the following patents assigned to Sturman Industries, which are incorporated by reference in their entirety herein: U.S. Pat. Nos. 5,829,396; 6,024,060; 6,308,690; 6,349,685; 6,354,185; and 6,360,728. The present invention may utilize the switching valve technology described in the above-referenced patents in a vehicle engine configured for mass production.

Force translators 56, 58 transmit force from the oil pressure within the fluid apertures 52, 54 to the shafts 60, 62 of the exhaust and intake valves 20, 22.

The force translators 56, 58 each include a movable sleeve 64, 66 and a movable pin 68, 70 inside the respective sleeves 64, 66. When sufficient pressure is applied, the movable sleeves 64, 66 move with the respective movable pins 68, 70 until the sleeves 64, 66 bottom out against a stop surface and the pins 68, 70 continue to move. Sensors 72, 74 read the tapered surfaces 76, 78 of the pins 68,70 to determine the vertical position of the pins for control purposes. The pins 68,70 are proprietary technology of Sturman Industries.

Figure 2:
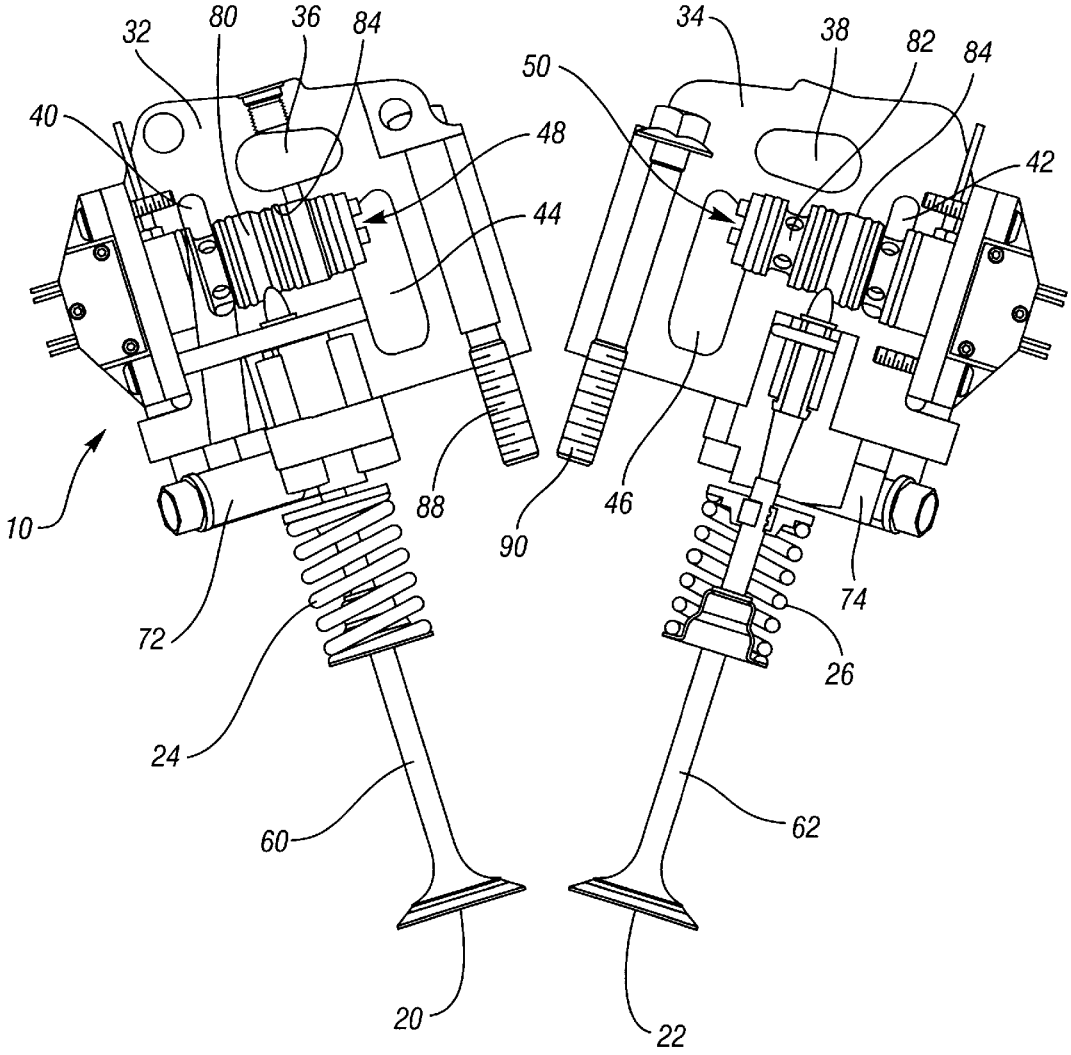
FIG. 2 shows a partial cross-sectional view of components of the camless engine of FIG. 1.

FIG. 2 is a partial vertical cross-sectional view illustrating components of the careless engine 10 of FIG. 1, taken at a slightly off-set longitudinal position of the engine 10 with respect to FIG. 1. In this view, the solenoid portions 80, 82 of the switching valves 48, 50 are visible. As shown, the solenoid portions 80, 82 of the switching valves 48, 50 are positioned within respective switching valve mounting bores 84, 86. Attachment bolts 88, 90 are also visible for mounting the manifolds 32, 34 to the cylinder head 12.

Figure 3:
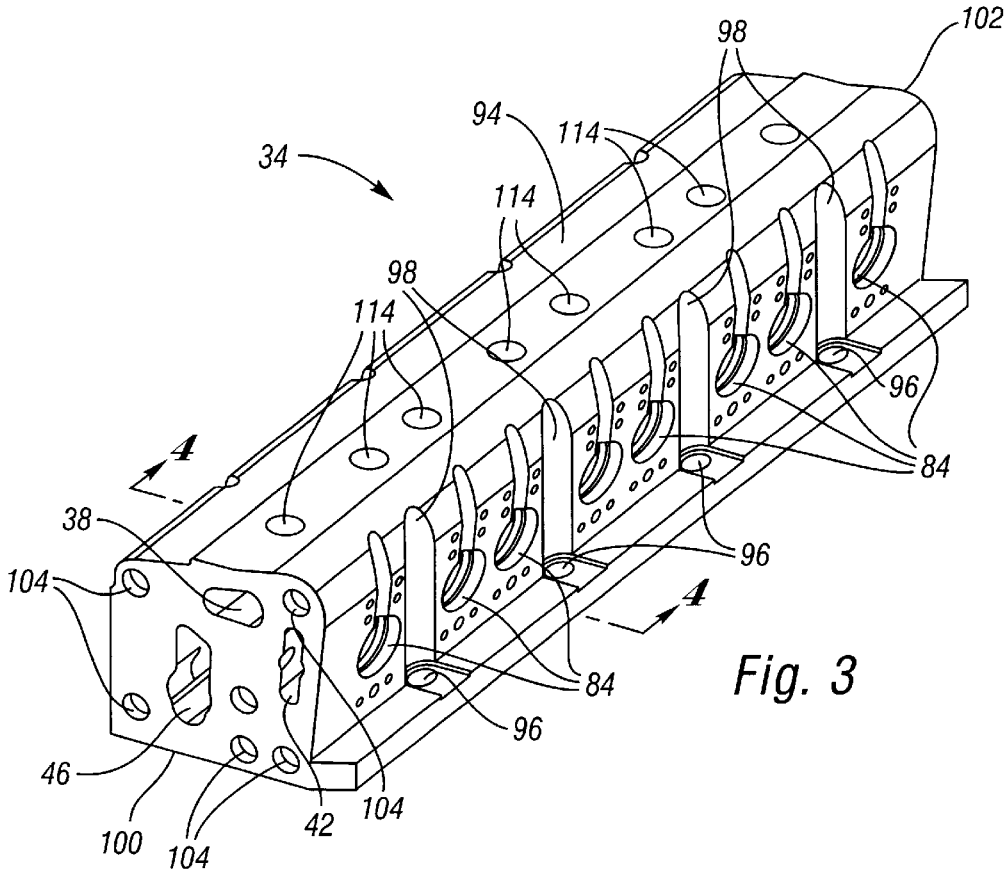
FIG. 3 shows a perspective view of an extruded aluminum manifold body for use with the camless engine of FIG. 1.
Figure 4:
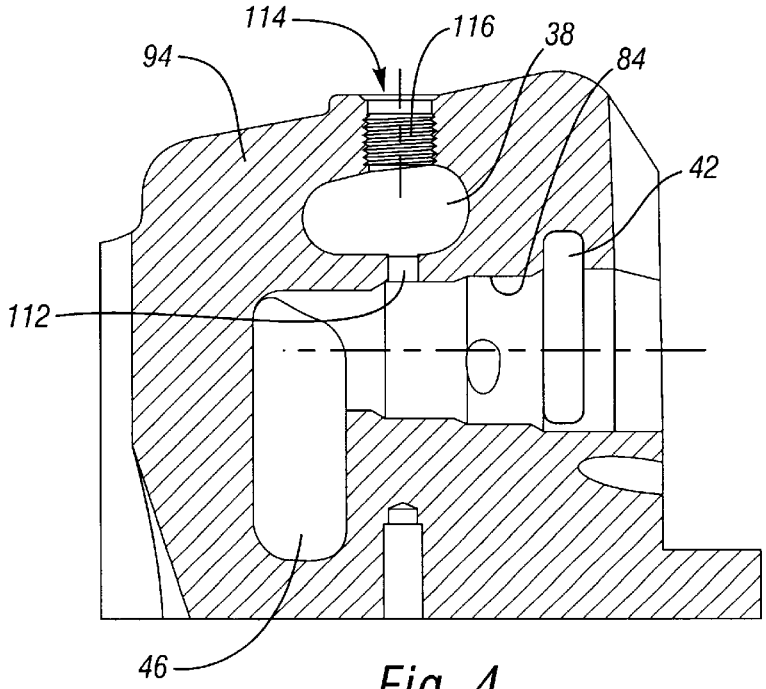
FIG. 4 shows a vertical cross-sectional view taken at line 4—4 of FIG. 3.
Figure 5:
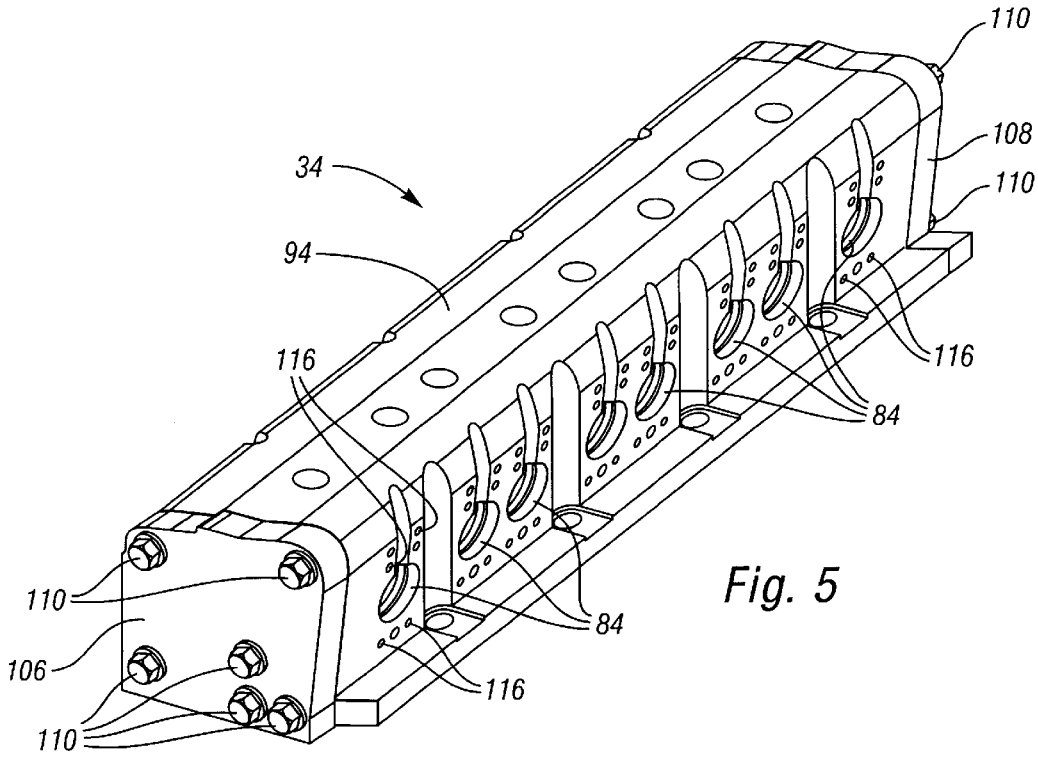
FIG. 5 shows a perspective view of an assembled manifold for use with the camless engine of FIG. 1.

The invention is particularly characterized by the extruded aluminum manifolds 32, 34, which are shown in greater detail in FIGS. 3–5. As shown in FIG. 1, the manifolds 32, 34 are sufficiently similarly configured so that a manifold body extrusion may be formed and then cut to desired lengths to form the left and right manifolds 32, 34 in a four-cylinder, six-cylinder or eight-cylinder engine.

Referring to FIG. 3, the manifold 34 has an extruded aluminum body 94 with the first, second and third channels 38, 42, 46 extruded therein, and the switching valve mounting bores 84 are machined into the body 94. The body 94 also includes recessed attachment bolt holes 96 for attaching the manifold 34 to the cylinder head 12. Relief slots 98 are also provided along the sides of the body 94 to facilitate access for driving bolts into the attachment holes 96.

The first and second ends 100, 102 of the body 94 include bolt holes 104 to facilitate attachment of the end caps 106, 108 via the bolts 110, as shown in FIG. 5. The end caps 106, 108 enclose the ends of the first, second and third channels 38, 42, 46.

As shown in FIG. 4, the switching valve mounting bore 84 is machined into the body 94, and intersects the channels 42, 46. A connector channel 112 is drilled into the body 94 to connect the channel 38 to the switching valve mounting bore 84. The opening 114 which is machined into the body 94 to form the connector channel 112 is threaded 116 to facilitate screw-in attachment of plugs to plug the hole 114. As shown in FIG. 3, a plurality of such holes 114 are provided along the upper surface of the body 94. FIG. 5 also illustrates the mounting holes 116 formed adjacent the switching valve mounting bores 84 to facilitate bolt-in attachment of the switching valves 48, 50.

As most clearly shown in FIG. 4, the high-pressure channel 38 is substantially oval-shaped in vertical cross-section to provide reduced stress.

Figure 6:
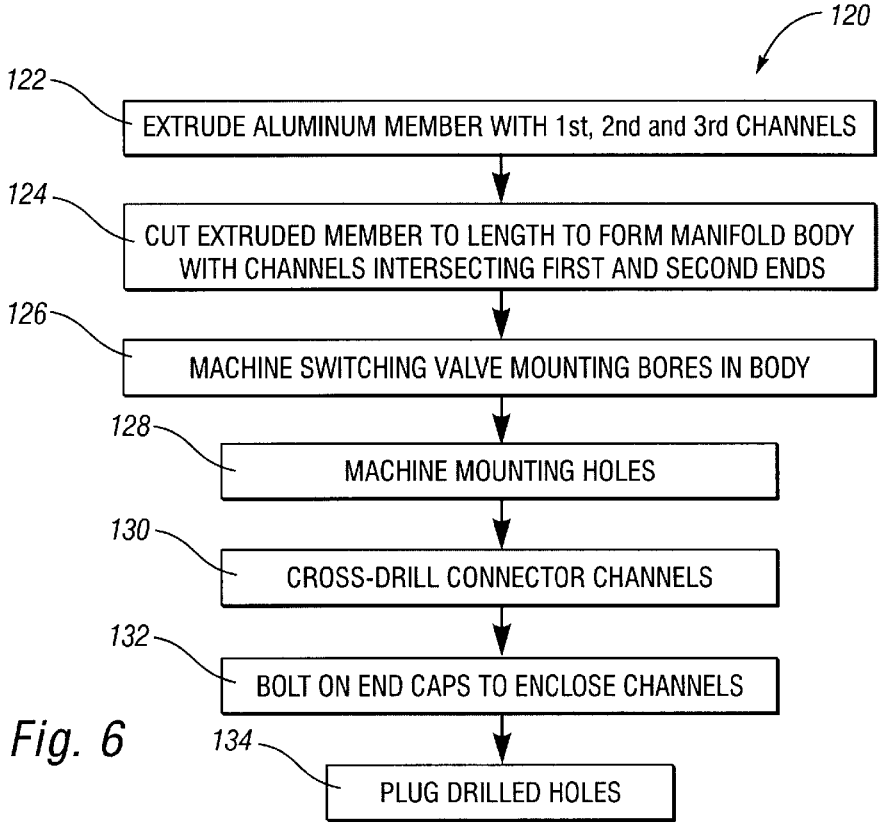
FIG. 6 is a schematic flow chart illustrating a method of manufacturing an oil manifold for a camless engine.

FIG. 6 schematically illustrates a method 120 for manufacturing an oil manifold for a camless engine. The method includes extruding an aluminum member with first, second and third channels formed therein (step 122). The extrusion process is performed as using the following parameters:

| | |
|---|---|
| Alloy: | 6061 |
| Temper: | T-6 |
| Billet temperature: | 950° F. |
| Ram speed: | 10.0 |
| Exit temperature: | 1025° F.–1035° F. |
| Quench rate: | WB/300% |
| Temperature after quench: | 110° F. |
| % stretch: | 0.7 |
| Age practice: | 8 hrs./350° F. still air cool |

The aluminum member may be extruded at a substantial length, such as 10 feet, and then cut to desired length to form the left and right manifold bodies 32, 34 of four-cylinder, six-cylinder, eight-cylinder, etc., engines. When the extruded member is cut to a desired length (step 124), manifold bodies are formed with channels intersecting first and second ends of the body. Switching valve mounting bores are then machined into the body (step 126). Mounting holes are machined in (step 128), connector channels are cross-drilled (step 130), end caps are bolted on to enclose the channels (step 132), and the drilled holes are plugged (step 134).

The extruded aluminum manifolds provide high tensile and yield strengths required to withstand the stresses induced by the high-pressure oil. The aluminum is also lightweight in comparison to steel, and allows the formation of the long internal channels of uniform cross-section for containment of the oil. These long channels of substantial volume are preferred for valve control at the hydraulic switching valves to minimize pressure and noise pulses.

While the best mode for carrying out the invention has been described in detail, those familiar with the art to which this invention relates will recognize various alternative designs and embodiments for practicing the invention within the scope of the appended claims.

What is claimed is:

1. A manifold for housing high-pressure oil on a camless engine, comprising:

an extruded aluminum body having first and second ends, and having first, second and third extruded channels formed therein and each extending from the first end to the second end of the body; and said body having a plurality of switching valve mounting bores configured to receive a plurality of switching valves operative to permit alternate communication of oil from the extruded channels to affect movement of cylinder valves of an engine to which the manifold is mounted.

2. The manifold of claim 1, wherein said body includes at least eight of said switching valve mounting bores formed therein.

3. The manifold of claim 1, further comprising end caps bolted to said first and second ends of the body to enclose said first, second and third channels.

4. The manifold of claim 1, wherein one of said first, second and third channels is configured to receive high-pressure oil, and is substantially oval-shaped in vertical cross-section to provide reduced stress.

5. A method of manufacturing an oil manifold for a camless engine comprising:

extruding an aluminum member having first, second and third channels therein;

cutting the extruded aluminum member to a desired length to form a manifold body having first and second ends with the first, second and third channels extending from the first end to the second end; and machining a plurality of switching valve mounting bores in the manifold body in fluid communication with the first, second and third channels.

6. The method of claim 5, further comprising bolting end caps to said first and second ends of the body to enclose said first, second and third channels.

7. The method of claim 5, wherein one of said first, second and third channels is extruded to form a substantially oval vertical cross-section to provide reduced stress for carrying high-pressure oil.

8. A camless engine comprising:

a cylinder valve operatively associated with an engine cylinder and having a return spring biasing the cylinder valve toward a closed position;

a fluid aperture operatively associated with the valve to provide pressurized fluid to selectively counteract force of the return spring to move the valve toward an open position;

said fluid aperture being formed in an extruded aluminum manifold body having first, second and third channels formed therethrough for carrying oil at different pressures; and a hydraulic switching valve operatively positioned in the manifold body between the fluid aperture and at least two of the first, second and third channels to alternately communicate said two of the first, second and third channels with the fluid aperture, wherein one of said two channels carries high-pressure oil and the other of said two channels carries low-pressure oil, thereby enabling communication of high-pressure or low-pressure oil through the fluid aperture to affect movement of the cylinder valve between the open and closed positions.

9. The camless engine of claim 8, wherein said extruded aluminum manifold body includes a plurality of said hydraulic switching valves associated with a plurality of cylinder valves, each of said hydraulic switching valves being operative to alternately communicate said two channels to a respective fluid aperture to affect movement of a respective cylinder valve.

10. The camless engine of claim 8, further comprising first and second end caps connected to opposing ends of said manifold body to enclose said first, second and third channels.

11. The camless engine of claim 8, wherein one of said first, second and third channels is extruded to form a substantially oval vertical cross-section to provide reduced stress for carrying high-pressure oil.

12. The camless engine of claim 8, further comprising a force translator between the fluid aperture and the cylinder valve for transmitting force from pressurized oil in the fluid aperture to the cylinder valve.

* * * * *